US005549768A

United States Patent [19]

Mahoney

[11] Patent Number: 5,549,768

[45] Date of Patent: Aug. 27, 1996

[54] PROCESS FOR IMPARTING A LOCALIZED FINE GRAIN MICROSTRUCTURE IN EDGE SURFACES OF ALUMINUM ALLOY SHEETS

[75] Inventor: Murray W. Mahoney, Camarillo, Calif.

[73] Assignee: Rockwell International Corporation, Seal Beach, Calif.

[21] Appl. No.: 530,541

[22] Filed: Sep. 19, 1995

Related U.S. Application Data

[63] Continuation of Ser. No. 300,816, Sep. 2, 1994, abandoned.

[51] Int. Cl.[6] ..... C22F 1/04

[52] U.S. Cl. ..... 148/695; 198/697

[58] Field of Search ..... 148/695, 696, 148/697; 29/889.1

[56] References Cited

U.S. PATENT DOCUMENTS

| | | | |
|---|---|---|---|
| 3,934,443 | 1/1976 | Keen | 72/75 |
| 3,966,506 | 6/1976 | Mandigo et al. | 148/695 |
| 4,092,181 | 5/1978 | Paton et al. | 148/12.7 A |
| 4,799,974 | 1/1989 | Mahoney et al. | 148/12.7 A |
| 5,302,218 | 4/1994 | Shirai et al. | 148/697 |

FOREIGN PATENT DOCUMENTS

| | | | |
|---|---|---|---|
| 5-179412 | 7/1993 | Japan | 148/695 |
| 1693114 | 11/1991 | U.S.S.R. | 148/695 |

*Primary Examiner*—George Wyszomierski
*Attorney, Agent, or Firm*—John C. McFarren

[57] ABSTRACT

A process of cold working followed by rapid recrystallization imparts a localized fine grain morphology in and around surfaces of fastener holes and edges in aluminum materials. A peening tool that may be employed for surface cold working includes a hollow housing with openings for retaining a plurality of ball peens that may be driven by rotating cams or an oscillating tapered piston operating within the housing to force the ball peens to impact the surfaces of an edge, cavity, or fastener hole to which the tool is applied. The tool may be shaped to accommodate straight bored, counter bored, countersunk, and/or edge surfaces and may be applied manually or automatically for cold working over substantially the entire surface area of the edge or cavity. The peening tool effects localized cold working to a predetermined and controlled depth to break up the existing large pancake-shaped grain structure in the surface of the aluminum alloy. After the surfaces have been cold worked, rapid heating recrystallizes the cold worked surfaces to attain a localized fine grain corrosion and fatigue resistant microstructure. The process provides the benefits of exfoliation corrosion resistance and improved fatigue life by using microstructural control rather than chemical coatings that may be harmful to the environment. The process produces a stable microstructure that allows subsequent use of other treatments to act in parallel as multiple barriers to corrosion.

17 Claims, 4 Drawing Sheets

PROCESS FOR IMPARTING A LOCALIZED FINE GRAIN MICROSTRUCTURE IN EDGE SURFACES OF ALUMINUM ALLOY SHEETS

This application is a continuation of application Ser. No. 300,816 filed Sep. 2, 1994, now abandoned.

TECHNICAL FIELD

The present invention relates to methods of processing aluminum materials and, in particular, to a process of cold working and recrystallizing selected surfaces in aluminum alloys, such as localized surfaces along sheet edges and in and around fastener holes, to form a fine grain microstructure having improved corrosion and fatigue resistance.

BACKGROUND OF THE INVENTION

Exfoliation corrosion of high strength aluminum alloys occurs when edges of the metal surfaces are exposed to environments containing acids and salts. Aircraft structures, for example, are particularly susceptible to exfoliation corrosion around areas such as fastener holes and other edges, where transverse sections of the microstructure are exposed, effective washing is difficult, and corrosive solutions collect. Exfoliation corrosion produces destructive effects that limit the useful life of aircraft components and other high strength structural aluminum parts.

In the prior art, U.S. Pat. No. 4,092,181 describes a thermomechanical "Method of Imparting a Fine Grain Structure to Aluminum Alloys Having Precipitating Constituents" for creating a fine grain morphology throughout the entire thickness of aluminum alloy sheet material. U.S. Pat. No. 4,799,974 describes a thermomechanical "Method of Forming a Fine Grain Structure on the Surface of an Aluminum Alloy" for creating a fine grain morphology on the entire surface of high strength aluminum alloy sheet material. These methods define the accepted practices for bulk and surface processing of aluminum alloys and teach certain steps that have been deemed necessary to attain a stable fine grain size. The following steps, with only minor variations for expediency or cost considerations, are generally performed in these conventional methods to achieve a fine grain microstructure on the surface of aluminum alloys:

1) Solution treat the material at about 480° C. for 30 minutes to put all second phases into solution;
2) Age the material at about 400° C. for 8 hours to develop a duplex precipitate distribution of both fine and coarse precipitates;
3) Work the surface of the material at moderately low temperatures (rolling at less than about 200° C., for example);
4) Recrystallize the worked material as rapidly as possible (by submersing in a salt bath at about 480° C. for 15 minutes, for example); and
5) Age the material at low temperature for about 24 hours, for example, to achieve appropriate strength levels (such as T-6 and/or T-7, for example).

The foregoing process steps, which are sometimes difficult and lengthy, can add considerably to the cost of producing fine grain aluminum. Conventional through-thickness bulk processing to produce fine grain aluminum is generally limited to sheet material having a thickness less than about 0.08 inch. On the other hand, fine grain surface processing does not provide corrosion protection at locations, such as edges and fastener holes for example, where the microstructure has not been modified. The prior art, as described in U.S. Pat. Nos. 4,092,181 and 4,799,974, does not address the specific need for creating a localized fine grain microstructure along edges and around the openings and interior surfaces of high aspect ratio fastener holes, such as those used in aircraft structures. These locations, however, are the most susceptible sites for initiation of exfoliation corrosion. The prior art process steps listed above, including solution treatment and long time age, are not practical for localized microstructural control nor are they applicable to the particular geometry of fastener holes. In addition, conventional localized surface working procedures (such as shot peening or cold expansion, for example) do not impart uniform or sufficient work for corrosion resistance when applied to aluminum alloy edges and fastener hole surfaces. Shot peening is limited, at best, to low aspect ratio holes (i.e., thin sheets having large diameter holes). Furthermore, shot peening can severely distort the geometry of fastener holes, thus requiring subsequent machining that results in removal of the worked surface. Cold expansion processes, commonly used to impart fatigue resistance to fastener holes, do not effect localized deformation to initiate fine grain recrystallization, and thus do not provide improved corrosion resistance.

In addition to the limitations of prior art fine grain processes, new environmental restrictions prevent the use of coatings previously relied on to impart corrosion resistance to fastener locations in aluminum alloys. Many of the chemicals used in such coating processes are now restricted or banned as harmful to the environment. Thus, there is a need for environmentally acceptable methods for providing corrosion resistance at selected surface locations in aluminum alloy structures such as edges and fastener holes in aircraft components.

SUMMARY OF THE INVENTION

Fine grain processing of aluminum materials at selected locations, such as edges, fastener holes, or other cavities in aluminum components or parts of aging aircraft, is fundamentally different from conventional practices used for bulk or surface fine grain processing of aluminum sheet material. Two important steps have been identified as necessary to achieve a fine grain surface morphology along edges and in and around fastener holes. The first step is a cold working operation that imparts localized work to break up the existing large pancake-shaped grain structure that is exposed along edges and in holes. The second step is recrystallization of the aluminum alloy with a high rate of heating to nucleate a fine grain microstructure at the surfaces of edges and fastener holes. Unfortunately, because of the specialized geometry involved with edges and cavities such as fastener holes, neither of these steps can be performed effectively with common metal working procedures.

The method of the present invention may utilize peening tools adapted for cold working aluminum alloys to impart a fine grain surface microstructure along edges and to interior and surrounding surfaces of fastener holes. The process provides the benefits of exfoliation corrosion resistance and improved fatigue life by using microstructural control rather than chemical coatings that are harmful to the environment. Because the process creates a localized fine grain microstructure that remains stable even with subsequent heat treatments (as compared to a residual compressive stress), other treatments may be used in parallel with microstructural control to act as multiple barriers to corrosion.

The peening tools utilized in the process of the present invention are adapted to effect localized work to surfaces of aluminum alloy edges and fastener holes. In preferred embodiments, the tool may comprise a hollow housing with openings for retaining a plurality of ball peens that may be driven by rotating cams or an oscillating tapered piston operating within the housing, for example, to force the ball peens to impact (and deform to a controlled depth) the surfaces of an edge to which the tool is applied or a cavity or fastener hole into which the tool is inserted. The tool may be shaped to accommodate edges or straight bored, counter bored, and/or countersunk surfaces so that the ball peens impact the surrounding and interior surfaces of cavities or edges substantially normal to the surfaces. The tool may be applied, inserted, rotated, and withdrawn manually or automatically to effect cold working over substantially the entire surface area of the edge or cavity. There is no material thickness limit for the process. After the surfaces have been cold worked, rapid localized heating is performed to recrystallize the cold worked surfaces to attain a fine grain corrosion and fatigue resistant microstructure.

A principal object of the invention is to impart corrosion and fatigue resistance to localized surfaces such as edges and fastener holes in aluminum materials. Features of the invention include cold working the surfaces in and around fastener holes and edges of aluminum materials without prior solution treatment, followed by rapid recrystallization without subsequent age treatment. An advantage of the invention is the creation of a fine grain corrosion and fatigue resistant surface microstructure in, around, and along aluminum alloy fastener holes and edges without the use of environmentally objectionable chemical treatments and coatings.

BRIEF DESCRIPTION OF THE DRAWINGS

For a more complete understanding of the present invention and for further advantages thereof, the following Detailed Description of the Preferred Embodiments makes reference to the accompanying Drawings, in which.

DETAILED DESCRIPTION OF THE PREFERRED EMBODIMENTS

Figure 1A:
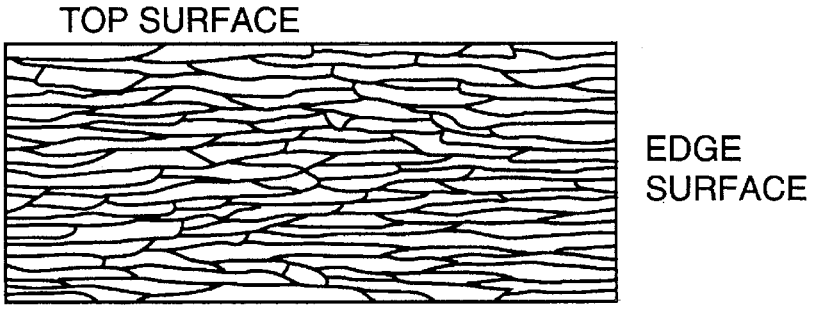
FIG. 1A is a schematic depiction of a section of conventionally processed aluminum alloy sheet material having a top surface, an edge surface, and an elongated grain structure.
Figure 1B:
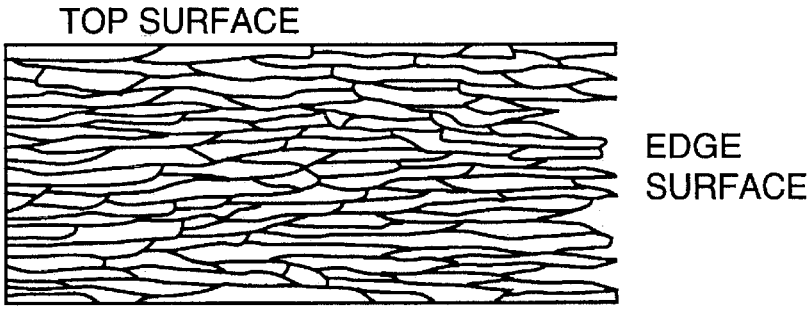
FIG. 1B is a schematic depiction of the aluminum alloy sheet material of FIG. 1A showing exfoliation corrosion along the edge surface.

In conventionally processed aluminum alloys, as depicted schematically in FIG. 1A, the starting grain size is generally large with a high aspect ratio. For example, starting grain size in aluminum sheet material is typically about 15 μm in the short through-thickness (or transverse) direction and about 50 μm in the rolling direction. These elongated grains are detrimental in an exfoliation corrosion environment where long grain boundaries allow corrosion to propagate over large distances. This is particularly true at fastener holes and edges, as depicted schematically in FIG. 1B, where the transverse microstructure is exposed to the environment.

Figure 1C:
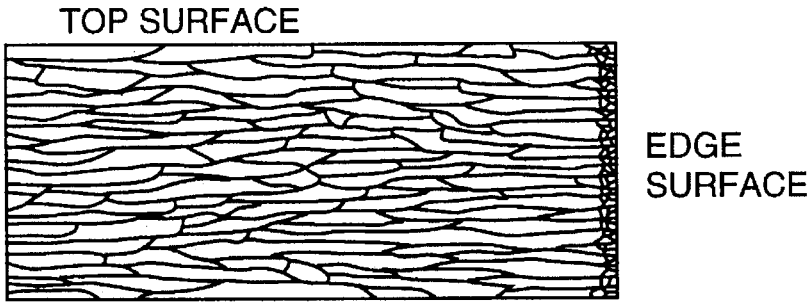
FIG. 1C is a schematic depiction of the aluminum alloy sheet material of FIG. 1A that has been processed to form a localized fine grain structure on the edge surface.

Producing a fine grain surface microstructure in aluminum alloys for corrosion resistance at selected locations, such as along edges and around the inside of fastener holes in aluminum components and aging aircraft parts, as depicted schematically in FIG. 1C, is fundamentally different from conventional methods of fine grain bulk or surface processing of aluminum sheet material. The first step in forming a fine grain surface morphology in and around aluminum alloy fastener holes or along edges involves localized cold working to break up the existing pancake-shaped large grain structure. The second step involves recrystallization at a high rate of localized heating to nucleate a fine grain structure on the interior and surrounding surfaces of the fastener hole or edge. Although cold working and subsequent recrystallization are conventional metal working procedures, these two steps alone have not been applied to form a fine grain surface microstructure, and no fine grain process has been applied in a localized area within a cavity or along an edge in aluminum alloys. Solution treatment and conventional long-time age treatment for grain refinement by precipitate nucleation in bulk aluminum alloys are not necessary for edges and fastener holes where surface nucleation of grains is the operative mechanism.

FINE GRAIN SURFACE PROCESSING

The two step process of cold working followed by rapid recrystallization to produce a fine grain surface structure is useful for both edges and fastener holes in aluminum components and for repair of aging aircraft parts in the field. This fine grain process for localized surfaces of fastener holes, edges, and similar corrosion sensitive areas of aluminum alloy materials eliminates several of the costly and time-consuming conventional fine grain processing steps required for bulk materials or the entire surfaces of sheet material. With the current process, in contrast to conventional aluminum grain refinement procedures, there is no limitation on the thickness of the structural component being worked and access is needed from only one side of the component.

In the method of the present invention, the initial prior art step of solution treating the aluminum alloy is eliminated. Solution treatment is used in conventional processes to put all second phase precipitates into solution so that they can be subsequently reprecipitated in controlled sizes and distributions. In the present method, however, precipitates are not necessary for surface nucleation of fine grains and, therefore, a solution treatment step is not required. Elimination of this step allows the surface of material already in a T-6 or T-7 aged condition to be processed without a high temperature solution treatment. This is particularly beneficial for repair of aging aircraft in the field because it is not practical to require solution treatment of all aircraft fastener holes prior to fine grain processing.

The present method also eliminates the prior art requirement for long term aging. Long term aging (e.g., 400° C. for 8 hours) develops a bimodal coarse and fine precipitate distribution. The fine precipitates serve to retard grain growth during high temperature superplastic forming (SPF). Except for SPF applications, aluminum alloys are never exposed to temperatures high enough to cause grain growth (i.e., temperatures greater than about 450° C. for extended times). Fine precipitates, therefore, are not required for fastener holes or other such selected locations in aluminum alloys. The long term aging step also develops a distribution of larger precipitates that act as new grain nucleation sites during recrystallization. In and around fastener holes, the required depth of grain refinement for corrosion and fatigue retardation can be very small, less than about 100 μm for example. The present invention utilizes the fact that for a small skin depth, fine grains are nucleated via active surface nucleation sites, as opposed to large precipitate nucleation sites within the bulk of the material. Therefore, large precipitates are not required for "surface" fine grain refinement. Accordingly, the impractical, high temperature, long term aging treatment used in conventional fine grain processing is not necessary for edge, fastener hole, or similar localized surface fine grain refinement.

In the present method, extensive working through the thickness of the material is not required because grain refinement is only necessary to limited depths (e.g., about 100 μm). Therefore, working to produce significant reduction in the thickness of the material is not necessary. The current method introduces superficial surface deformation only, which can be accomplished at room temperature with peening tools of the present invention. Selective working allows grain refinement in repair applications or isolated locations of large structures. The present method is not limited to sheet material or a maximum sheet thickness as in conventional fine grain processing.

Rapid recrystallization is required with the present method after cold working of the surface area. Unlike conventional methods, however, recrystallization of small surface volumes of material can be accomplished with special "field" tooling and procedures. Localized heating may be accomplished, as during repair of aging aircraft for example, using heated copper rods, scanning lasers, or microwave devices applied to edges or inserted into fastener holes. Because the volume of material to be heated is low, recrystallization can be accomplished with short heating times (e.g., less than about 30 seconds for most materials). When processing newly fabricated aluminum components (rather than repairing aging aircraft), conventional recrystallization procedures may be used after cold working the surfaces of edges and holes.

For repair of aging aircraft, the conventional process step of artificial aging to achieve high strength in the recrystallized material is not necessary given the small surface volumes of material processed with the present method. The material surrounding the processed surface area is already aged to high strength and, because of the triaxial constraints on this small volume, the new fine grain annealed material will approach the properties of the surrounding material. Furthermore, within a short period of time aluminum alloys age naturally, and strength levels in the annealed volume will approach T-6 and T-7 strengths without artificial aging treatments. For fabrication of new components, conventional aging procedures may be applied after localized fine grain processing without altering the benefits of the fine grain microstructure.

PEENING TOOLS

Figure 2:
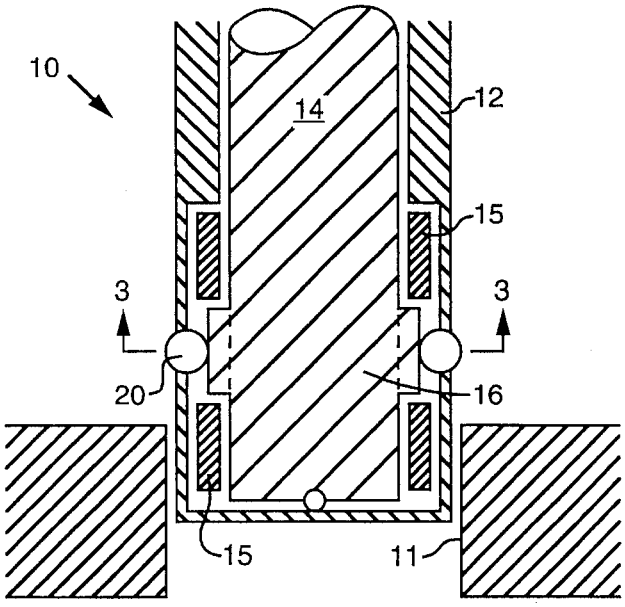
FIG. 2 is a longitudinal cross section of an embodiment of an aluminum alloy peening tool having a rotating cam shaft for impacting ball peens a controlled distance against a fastener hole surface.

FIG. 2 is a longitudinal cross section of the working end of an embodiment of a peening tool 10 designed to impart localized work to the interior surface 11 of an aluminum alloy fastener hole. Peening tool 10 is operated in a manner similar to a drill bit using an electric or pneumatic driver, for example. Tool 10 can be provided in various dimensions to accommodate different diameter holes, and it can produce various depths of cold working in surface 11 as required depending on the dimensions of the tool and ball peens.

Figure 3:
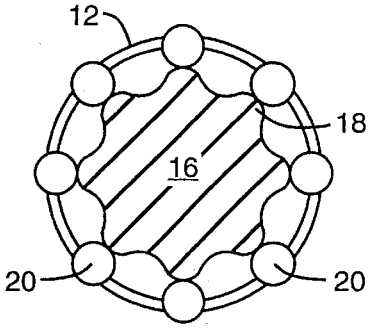
FIG. 3 is a cross section of the peening tool of FIG. 2 taken at the section line 3—3.

As illustrated in FIG. 2, peening tool 10 comprises a cylindrical housing 12 for a rotating shaft 14. Bearings 15 may be provided for supporting the rotation of shaft 14 within housing 12. Shaft 14 includes a cam section 16 having at least one cam 18 (as shown in FIG. 3) for impacting a plurality of ball peens 20 retained in circular openings spaced apart in one or more rings around the periphery of housing 12. As best shown in FIG. 3, which is a cross section of tool 10 taken at the section line 3—3 of FIG. 2, rotation of shaft 14 causes one or more cams 18 of cam section 16 to drive ball peens 20 in a pulsed manner a short distance (determined and controlled by the size of ball peens 20, the openings in housing 12 for ball peens 20, and the dimensions of cam section 16 and cams 18) radially outward of cylindrical housing 12. As tool 10 is inserted into an aluminum alloy fastener hole, ball peens 20 repeatedly impact surface 11, thereby cold working surface 11 to break up large pancake-shaped aluminum alloy grains and produce a finer grained, corrosion resistant microstructure. The entire surface 11 is cold worked by inserting and withdrawing tool 10 while housing 12 is rotated, either manually by an operator or automatically by the electric or pneumatic driver.

Figure 4:
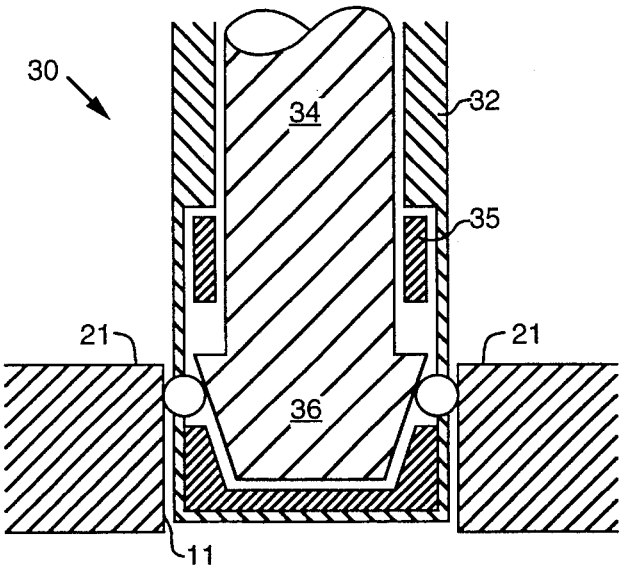
FIG. 4 is a longitudinal cross section of an alternative embodiment of an aluminum alloy peening tool having an oscillating piston with a tapered shaft for driving ball peens a controlled distance against a fastener hole surface.

Referring to FIG. 4, peening tool 30 illustrates an alternative embodiment of the present invention. Tool 30 comprises a cylindrical housing 32 for an oscillating plunger or piston 34. Bushings 35 may be provided for supporting and guiding piston 34 within housing 32. Piston 34 includes one or more tapered sections 36 for impacting ball peens 20 retained in circular openings spaced apart in one or more rings around the periphery of housing 32. In other respects, operation of tool 30 is similar to that of tool 10.

Exfoliation corrosion evaluations have revealed that both interior surface 11 and exterior surface 21 immediately surrounding a fastener hole should be corrosion resistant. Exterior surface 21 can be made corrosion resistant if the aluminum alloy sheet material is fabricated (or purchased) with special processing to impart a fine grain microstructure on the surfaces. This approach, however, adds considerably to the cost of the final product and is not necessary when corrosion resistance is required only in particular areas. Furthermore, this approach does not address the need for improved corrosion resistance on aging aircraft parts where a localized remedial approach is needed.

Figure 5A:
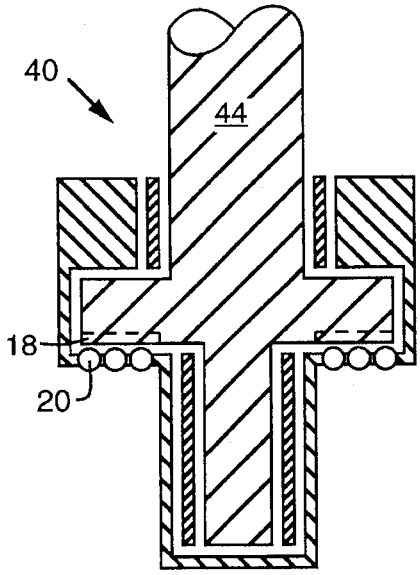
FIG. 5A is a longitudinal cross section of an embodiment of an aluminum alloy peening tool for impacting ball peens against a counter bore or top surface of a fastener hole.
Figure 6A:
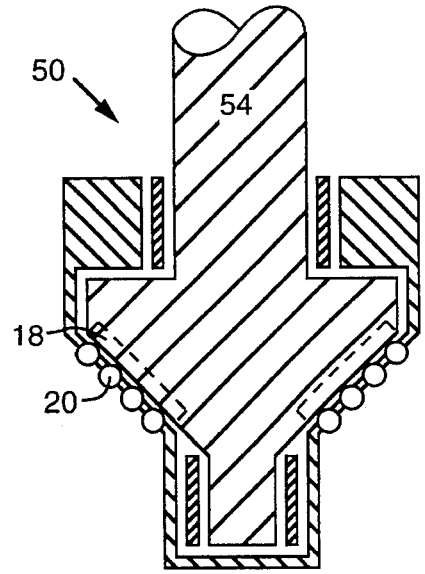
FIG. 6A is a longitudinal cross section of an embodiment of an aluminum alloy peening tool for impacting ball peens against a countersunk surface of a fastener hole.
Figure 5B:
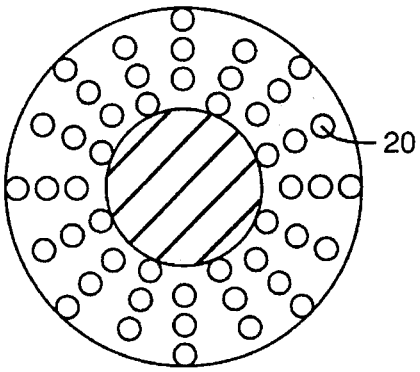
FIG. 5B is a bottom plan view of the counter bore peening tool of FIG. 5A.
Figure 6B:
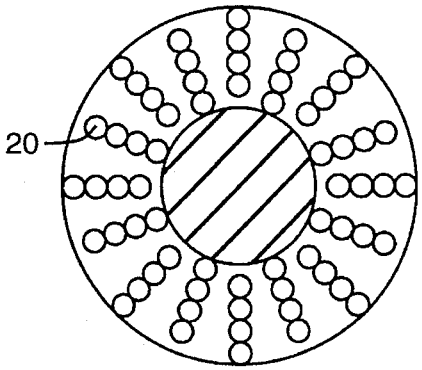
FIG. 6B is a bottom plan view of the countersink peening tool of FIG. 6A.
Figure 7:
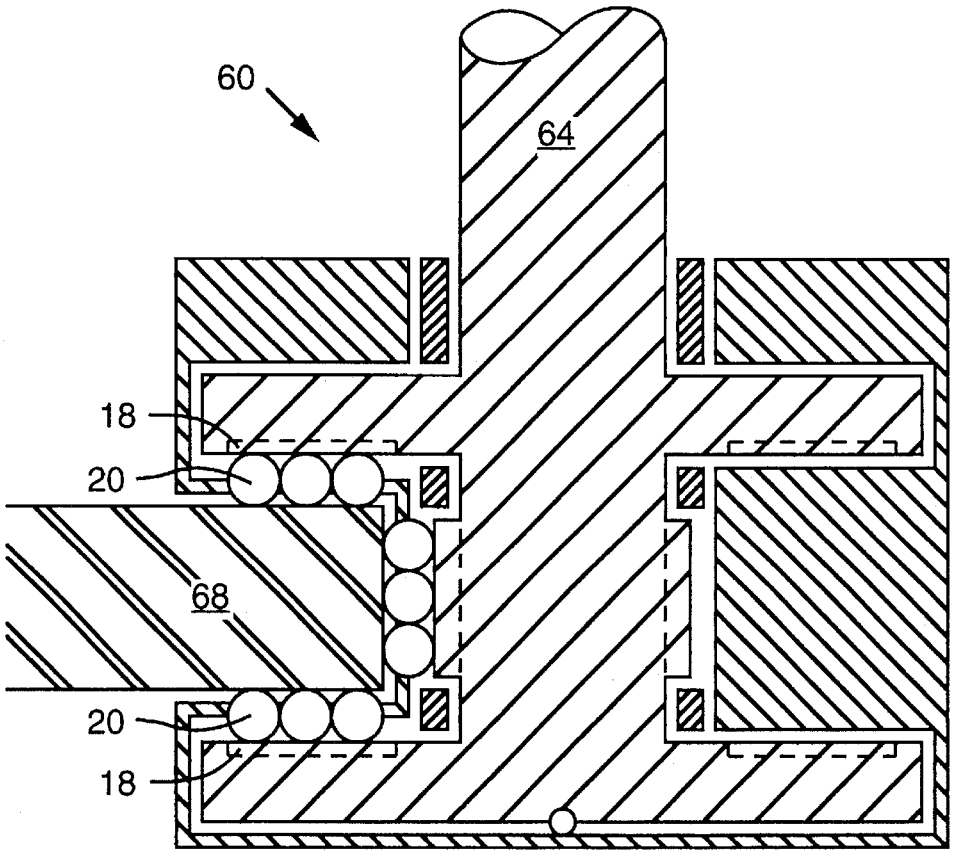
FIG. 7 is a longitudinal cross section of an embodiment of an aluminum alloy peening tool for impacting ball peens against edge surfaces of aluminum alloy sheet material.

Peening tools 10 and 30 can be modified to impart cold working for corrosion resistance on counter bored surfaces, in chamfer areas of countersink locations, and along edges of sheet material. Examples of peening tools designed for these special surfaces are illustrated in FIGS. 5, 6, and 7. FIG. 5A illustrates an embodiment of a peening tool 40 suitable for cold working a counter bore surface or a top surface surrounding a fastener hole. As best seen in the bottom view of tool 40 illustrated in FIG. 5B, ball peens 20 may be positioned in any of various arrangements to provide cold working over essentially the entire surface area covered by tool 40 as it is rotated in the bore hole. Ball peens 20 may be driven to impact the surface to be worked by action of shaft 44, which may include one or more cams that impact ball peens 20 as shaft 44 is rotated similar to the operation of tool 10, or which may be oscillated like piston 34 of tool 30. FIG. 6A and the corresponding bottom view of FIG. 6B illustrate an embodiment of a peening tool 50 suitable for cold working a countersink surface associated with a fastener hole. Operation of tool 50 is similar to that described above with respect to tool 40. Tools 40 and 50 may also be combined in various embodiments with tools 10 or 30 to cold work the interior, countersink, counter bore, and/or top surfaces of a fastener hole all in one operation. FIG. 7 illustrates an embodiment of a peening tool 60 designed for cold working component surfaces along an edge of sheet material 68. Operation of tool 60 is similar to that of the peening tools described above. Tool 60 may include ball peens 20 for cold working only the side surface of an edge or, as illustrated in FIG. 7, ball peens 20 positioned for cold working the side surface and areas of the top and bottom surfaces as tool 60 is moved along the edge of sheet material 68.

RECRYSTALLIZATION

For minimum grain size, the cold worked area of an aluminum alloy edge or fastener hole must be recrystallized as rapidly as possible. In a process suitable for detached components, a cold worked part can be submersed in a salt bath at about 480° C. to 500° C. Salt bath heating provides extremely high rates of heat transfer so that surface recrystallization of the cold worked aluminum alloy occurs in less than about 15 seconds. The process of the present invention has been used to cold work aluminum alloy fastener holes and produce an equiaxed grain size of about 6 μm to a depth of about 100 μm (or about 0.004 inch). The depth of microstructural refinement of the alloy is a function of the depth of the cold working, which can be adjusted and controlled by selecting appropriate dimensions for the components of the ball peening tools described above. The fine grain size achieved using this process is believed to be near the limits of grain refinement in aluminum alloys using conventional practices.

For fabrication of new structures where components are in the assembly stages, the foregoing recrystallization process is reasonably practical because, prior to assembly, the components can be salt bath recrystallized in their entireties and subsequently aged to T-6 or T-7 strength as required. However, for processing aging aircraft parts in a repair depot environment, an acceptable "field" process is required. In the field, unless a component is removed and replaced, only the surface area within and around a fastener hole or along an edge needs to be recrystallized rapidly. Thus, the volume of material in the heat affected zone around the recrystallized surface area can be kept to a minimum. Localized heating and recrystallization of cold worked fastener holes can be accomplished by inserting a tool such as a copper cylinder, which may include resistance heaters embedded in the interior and be relatively massive to retain heat. Because finer grain sizes are produced at the surface where the rate of heating is the highest, other localized heating techniques may prove effective. For example, a microwave device or a laser tool having a rotating mirror for beam scanning, could be inserted into a cold worked fastener hole or moved along an edge to generate rapid surface heating.

Although the present invention has been described with respect to specific embodiments thereof, various changes and modifications can be carried out by those skilled in the art without departing from the scope of the invention. Therefore, it is intended that the present invention encompass such changes and modifications as fall within the scope of the appended claims.

I claim:

1. A process of forming a corrosion resistant fine grain micro structure localized in a transverse edge surface of an aluminum alloy sheet having a large grain microstructure with long grain boundaries lying generally parallel to a longitudinal plane of said sheet, said edge surface transverse to said longitudinal plane and said long grain boundaries, comprising the steps of:

cold working said transverse edge surface without preparatory heat treatment by ball peening substantially normal to said transverse edge surface with sufficient force to cause localized break up of said large grain microstructure; and rapidly recrystallizing said cold worked transverse edge surface by localized heat treatment to attain said corrosion resistant fine grain microstructure localized in said cold worked transverse edge surface.

2. The process of claim 1, wherein said transverse edge surface comprises a surface of a fastener hole extending through said sheet, and said cold working step comprises inserting a ball peening tool into said fastener hole in said aluminum alloy sheet.

3. The process of claim 2, wherein said aluminum alloy sheet is attached to an aircraft and said cold working step comprises inserting a ball peening tool into said fastener hole in said aluminum alloy sheet attached to the aircraft.

4. The process of claim 1, wherein said cold working step comprises localized break up of said large grain microstructure to a surface depth of about 100 μm in said transverse edge surface.

5. The process of claim 1, wherein said step of rapidly recrystallizing comprises localized heat treatment of said transverse edge surface without subsequent age treatment of said aluminum alloy sheet.

6. The process of claim 1, wherein said step of rapidly recrystallizing comprises attaining said localized corrosion resistant fine grain microstructure to a depth of about 100 μm in said cold worked transverse edge surface.

7. A process of forming a corrosion resistant fine grain microstructure localized in a surface of a fastener hole of an aluminum alloy aircraft component having a large grain microstructure with long grain boundaries, said fastener hole surface transverse to said long grain boundaries, comprising the steps of:

cold working said fastener hole surface without preparatory heat treatment by ball peening substantially normal to said fastener hole surface with sufficient force to cause localized break up of said large grain surface microstructure without significant distortion of said fastener hole; and rapidly recrystallizing said cold worked fastener hole surface by localized heat treatment to attain said corrosion resistant fine grain microstructure localized in said cold worked fastener hole surface of the aluminum alloy component without subsequent age treatment of the aluminum alloy component.

8. The process of claim 7, wherein said cold working step comprises inserting a ball peening tool into said fastener hole in the aluminum alloy component.

9. The process of claim 7, wherein the aluminum alloy component is attached to an aircraft and said cold working step comprises inserting a ball peening tool into said fastener hole in the aluminum alloy component attached to the aircraft.

10. The process of claim 7, wherein said cold working step comprises localized break up of said large grain microstructure to a surface depth of about 100 μm in said fastener hole surface.

11. The process of claim 7, wherein said steps of cold working and rapidly recrystallizing produce said fine grain surface microstructure by surface nucleation.

12. The process of claim 7, wherein said step of rapidly recrystallizing comprises attaining said localized corrosion resistant fine grain microstructure to a depth of about 100 μm in said cold worked fastener hole surface.

13. A process of forming a corrosion resistant fine grain microstructure localized in a transverse edge surface of a sheet of aluminum alloy material attached to an aircraft, said aluminum alloy sheet having a large grain microstructure with long grain boundaries lying generally parallel to a longitudinal plane of said aluminum alloy sheet, said edge surface transverse to said longitudinal plane and said long grain boundaries, comprising the steps of:

cold working said transverse edge surface with sufficient force to cause localized break up of said large grain microstructure in said transverse edge surface without preparatory heat treatment of said aluminum alloy sheet attached to said aircraft; and rapidly recrystallizing said cold worked transverse edge surface by localized heat treatment to attain said corrosion resistant fine grain microstructure localized in said cold worked transverse edge surface.

14. The process of claim 13; wherein said cold working step comprises applying a peening tool to said transverse edge surface of said aluminum alloy sheet attached to the aircraft and peening substantially normal to said transverse edge surface without significant distortion of said transverse edge surface.

15. The process of claim 13, wherein said cold working step comprises localized break up of said large grain microstructure to a surface depth of about 100 μm in said transverse edge surface.

16. The process of claim 13, wherein said step of rapidly recrystallizing comprises localized heat treatment of said transverse edge surface without subsequent age treatment of said aluminum alloy sheet attached to said aircraft.

17. The process of claim 13; wherein said step of rapidly recrystallizing comprises attaining said localized corrosion resistant fine grain microstructure to a depth of about 100 μm in said cold worked transverse edge surface.

* * * * *